US008251226B2

(12) United States Patent
Martin et al.

(10) Patent No.: US 8,251,226 B2
(45) Date of Patent: Aug. 28, 2012

(54) METHOD AND APPARATUS FOR SEPARATING RESIDUES

(75) Inventors: Johannes Martin, Munich (DE); Michael Busch, Rosenheim (DE); Eva-Christine Langhein, Markt Schwaben (DE); Dragutin Brebric, Wettingen (CH)

(73) Assignee: Martin GmbH für Umwelt- und Energietechnik, München (DE)

( * ) Notice: Subject to any disclaimer, the term of this patent is extended or adjusted under 35 U.S.C. 154(b) by 0 days.

(21) Appl. No.: 13/065,740

(22) Filed: Mar. 29, 2011

(65) Prior Publication Data

US 2011/0180460 A1 Jul. 28, 2011

Related U.S. Application Data

(62) Division of application No. 11/811,559, filed on Jun. 11, 2007, now Pat. No. 7,971,724.

(60) Provisional application No. 60/897,015, filed on Jan. 23, 2007.

(30) Foreign Application Priority Data

Jul. 26, 2006 (DE) ..... 10 2006 035 260

(51) Int. Cl.
*B07B 9/00* (2006.01)

(52) U.S. Cl. ..... 209/32; 209/30; 209/44.2; 209/151; 209/312; 209/314

(58) Field of Classification Search ..... 209/19, 209/21, 44, 44.2, 149, 151
See application file for complete search history.

(56) References Cited

U.S. PATENT DOCUMENTS

| | | | | |
|---|---|---|---|---|
| 755,016 | A | 3/1904 | Koyl | |
| 1,941,212 | A * | 12/1933 | Johnson | 209/2 |
| 4,133,749 | A * | 1/1979 | Jelinek et al. | 209/24 |
| 4,321,134 | A * | 3/1982 | Leschonski et al. | 209/30 |
| 4,385,731 | A | 5/1983 | Balistreri | |
| 4,447,319 | A * | 5/1984 | Lazik | 209/11 |
| 4,849,116 | A | 7/1989 | Weinmann et al. | |

(Continued)

FOREIGN PATENT DOCUMENTS

CA 440 595 4/1947

(Continued)

OTHER PUBLICATIONS

German Search Report dated Jul. 10, 2007 with an English translation of the relevant portions.

(Continued)

*Primary Examiner* — Terrell Matthews
(74) *Attorney, Agent, or Firm* — Collard & Roe, P.C.

(57) ABSTRACT

The apparatus for separating residues from a thermal waste treatment into one fine fraction and one coarse fraction comprises a housing (1) abutting on swinging elements (2), said housing having a plurality of diagonally offset plates (3.1-3.5) that are disposed one beneath the other and are connected to said housing (1) by their side edges, and being equipped with means (5) for generating a vibration component oriented in the direction of the plates (3.1-3.5) disposed diagonally offset downward. The apparatus further comprises one suction line (6) as well as an inlet opening for a gas that may be passed between the plates for wind sieving. Residues or slag from a waste treatment plant or an incineration plant are supplied to this apparatus in order to separate them into at least one fine fraction and one coarse fraction.

12 Claims, 1 Drawing Sheet

U.S. PATENT DOCUMENTS

| | | | | |
|---|---|---|---|---|
| 5,138,982 | A | 8/1992 | Ohshita et al. | |
| 5,387,267 | A | 2/1995 | Warf et al. | |
| 5,556,232 | A * | 9/1996 | Malmgren | 405/129.2 |
| 5,728,196 | A * | 3/1998 | Martin et al. | 75/403 |
| 5,957,063 | A | 9/1999 | Koseki et al. | |
| 6,478,878 | B1 | 11/2002 | Tanaka et al. | |
| 2005/0061716 | A1 | 3/2005 | Centers et al. | |
| 2005/0115496 | A1 * | 6/2005 | Shutic et al. | 118/308 |

FOREIGN PATENT DOCUMENTS

| | | |
|---|---|---|
| CA | 471 273 | 2/1951 |
| CA | 799 808 | 11/1968 |
| CA | 1 248 914 | 1/1989 |
| DE | 409 266 | 2/1925 |
| DE | 26 11 401 | 9/1977 |
| DE | 195 05 385 | 8/1996 |
| DE | 297 09 918 | 10/1998 |
| EP | 0 318 054 | 5/1989 |
| EP | 0 691 160 | 1/1996 |
| GB | 899 449 | 6/1962 |
| JP | 48-15162 | 2/1973 |
| JP | 49-135264 | 12/1974 |
| JP | 2002-059083 | 2/2002 |
| JP | 2002-219417 | 8/2002 |
| WO | WO 02/02247 | 1/2002 |

OTHER PUBLICATIONS

European Search Report dated Oct. 22, 2007 with an English translation of the relevant portions.
Canadian Search Report dated Sep. 10, 2009.

* cited by examiner

METHOD AND APPARATUS FOR SEPARATING RESIDUES

CROSS REFERENCE TO RELATED APPLICATIONS

This application is a divisional of and Applicants claim priority under 35 U.S.C. §§120 and 121 of U.S. application Ser. No. 11/811,559 filed on Jun. 11, 2007, which claims priority under 35 U.S.C. §119 of German Patent Application No. 10 2006 035 260.2 filed Jul. 26, 2006 and under 35 U.S.C. §119(e) of U.S. Provisional Application No. 60/897,015 filed Jan. 23, 2007, the disclosures of each of which are hereby incorporated by reference.

BACKGROUND OF THE INVENTION

1. Field of the Invention

The invention relates to a method of separating residues from a thermal waste treatment into at least one fine fraction and one coarse fraction by which the residues are evacuated from a waste treatment plant in a dry state and separated into at least two fractions.

The invention relates also to an apparatus for separating residues from a thermal waste treatment in at least one fine fraction and one coarse fraction.

2. Prior art

A method of separating residues is known from EP 0 691 160 B1. There, the residues evacuated in a dry state from the waste treatment plant or rather from an incineration plant are at first given onto a bar screen where the oversized grain of dimensions greater than 300 mm is mechanically separated. This coarsely screened material is next passed over an electromagnetically driven 2 mm screen. In this way, the fine fraction is separated and conveyed to special treatment. The remaining rest of the residues is subjected to another treatment, namely to comminution, iron separation as well as to nonferrous metal separation.

The use of screens for separating the fine fraction of less than 2 mm has the disadvantage that the screens get clogged on the one side and that these screens are subjected to heavy wear on the other side.

SUMMARY OF THE INVENTION

It is the object of the invention to provide a method and an apparatus in order to allow for the most efficient possible separation of the fine fraction from the coarse fraction and to avoid heavy wearing of the apparatus parts, to enable the evacuated, still hot residues to react subsequently and to prevent dust formation during classification.

With a method of the type mentioned herein above, this object is solved by the fact that the residues are subjected to vibrations and conveyed downward in cascades over at least one stage on paths and on freefall paths lying therein between and that, in the region of the freefall paths, the fine fraction is evacuated by a gas flow, the coarse fraction, except for the fine fraction evacuated by wind sieving, being conveyed along the cascade path.

An important point of this method is that the residues are not passed, through one or several screens like in prior art but are conveyed on plates by vibrations so that, except for the fines evacuated by wind sieving, the rest of the residues is conveyed along the cascade path, preferably along the entire length of the cascade path.

The plates may thereby be implemented either without holes or comprise holes or passages through which part of the residues reach the metal sheet located there beneath before the freefall path. As a result, agglomerations are broken up by the vibrations on the one side and in particular by the freefall, a very good separation between the fine fraction and the coarser main fraction being made possible on the freefall paths in particular through the gas flow preferably oriented across this falling movement.

Another advantage is that, using for wind sieving a gas containing oxygen, the residues undergo a subsequent reaction, in particular in the region of the freefall paths, so that the quality of the slag is improved as a result of the higher degree of burnout obtained.

Controlled aspiration when generating a gas flow for wind sieving prevents dust from escaping, this being usually avoided by utilizing wet deslaggers the disadvantage of which being that the evacuated residues or the evacuated slag has an increased weight which increases the landfill costs.

Further, since there are no agglomerations, the separation of the various fractions in the dry state is much more effective. The controlled aspiration for achieving wind sieving also prevents the gas used for wind sieving from flowing back into the waste treatment plant or the incineration plant.

The paths may be arranged for the residues to be conveyed on the path by vibration. Advantageously though, the paths are disposed obliquely.

Good separation is achieved in particular if the residues are conveyed downward over several stages.

Separation may also be improved in that the fine fraction is evacuated by a gas flow in the region of the conveying vibration as well.

In practice, it has proved efficient to have the gas flow running transverse to the direction of the fall. Another advantage is obtained if it runs in a direction opposite to the conveying vibration.

In order to achieve effective classification, wind sieving occurs, in another implementation of the invention, on the freefall paths and between the paths of conveying vibration at an adjustable gas speed of 2 through 10 m/s, preferably of between 3 and 5 m/s.

For obtaining the fine fraction separated from the main fraction by wind sieving, there is provided, in another implementation of the invention, that the gas flow is first supplied to a cyclone separator after wind sieving and then, at need, subjected to a filtering process.

If, in another implementation of the invention, the ambient air or gas used for wind sieving originates from a region of the waste treatment plant or waste incineration plant in which there is still a lot of unconsumed oxygen, the further reaction during wind sieving is promoted in order to achieve improved burnout of the residues, this provision also allowing to prevent leak air penetration into the combustion chamber, which would be possible as a result of the lacking surge tank in the deslagger.

In still another advantageous implementation of the invention, the fine fraction separated by wind sieving is again supplied to thermal waste treatment. It is known that this fine fraction is much more loaded with contaminants than the coarser main fraction so that this recirculation results in either a destruction of these contaminants or in an improved incorporation in vitrified slag. The carrier air or carrier gas can be supplied to the incineration plant. This means that the fumes are recirculated to the wind sieving of the incineration plant.

It is advantageous if different flow velocities are adjusted between 25 the discrete conveying plates.

The invention also relates to an apparatus for separating residues from a thermal waste treatment into a fine fraction and into a coarse fraction. This apparatus is intended to overcome the prior art disadvantages and in particular to avoid the risk of clogging of the sieves as well as increased wear and it is intended to allow for implementation of the advantageous method described herein above.

The apparatus for separating residues from a thermal waste treatment 10 into at least one fine fraction and into a coarse fraction is characterized by a housing abutting on swinging elements, said housing having a plurality of diagonally offset plates that are disposed one beneath the other and being equipped with means for generating a vibration component oriented in the direction of the plates disposed diagonally offset downward.

With this apparatus, classification into the fine fraction and a coarse main fraction occurs substantially by wind sieving in the freefall paths in between the oblique plates. During this fall, agglomerations are dissolved and the fines are liberated. An advantage is obtained if the plates are connected to the housing at their side edges.

If, in another implementation of the invention, the plates are connected to the housing so that their inclination is adjustable, it is possible to influence the conveying vibrations and to adapt the flow characteristics of the residues. In a developed implementation, at least one suction line may be provided on the side of the housing confronting the evacuation side.

It is further suggested to provide a preferably adjustable inlet opening for a gas adapted to be led between the plates for wind sieving.

Moreover, the device may comprise a supplying device for dry residues of the waste treatment plant.

For separating the separated fine fraction, a cyclone, and at need a filter as well, are mounted in the suction path downstream of the housing.

If, in another implementation of the invention, an inlet for the gas serving for wind sieving is connected to a region of the waste treatment plant still containing lots of unconsumed oxygen, the residues evacuated in the dry state are allowed to undergo a subsequent reaction, and the gas is prevented from being recirculated into the burnout region upon completion of firing in the waste treatment plant. Since the gas/air flow is lined, defined, recirculation into the incineration plant is advisable since it allows for volumetric-flow or oxygen-mass equivalent replacement of combustion air or turbulent air.

BRIEF DESCRIPTION OF THE DRAWINGS

The invention will be explained herein after with reference to an exemplary embodiment illustrated in the drawing.

In said drawing

DETAILED DESCRIPTION OF PREFERRED EMBODIMENTS

Figure 2:
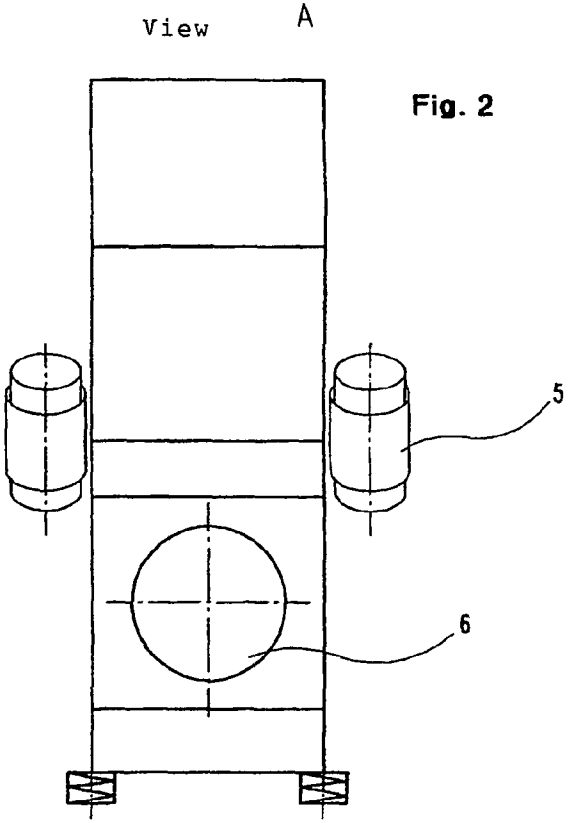
FIG. 1 shows a side view of an apparatus for separating residues from a thermal waste treatment and FIG. 2 shows a view of the plant shown in FIG. 1 pursuant to arrow A.
Figure 1:
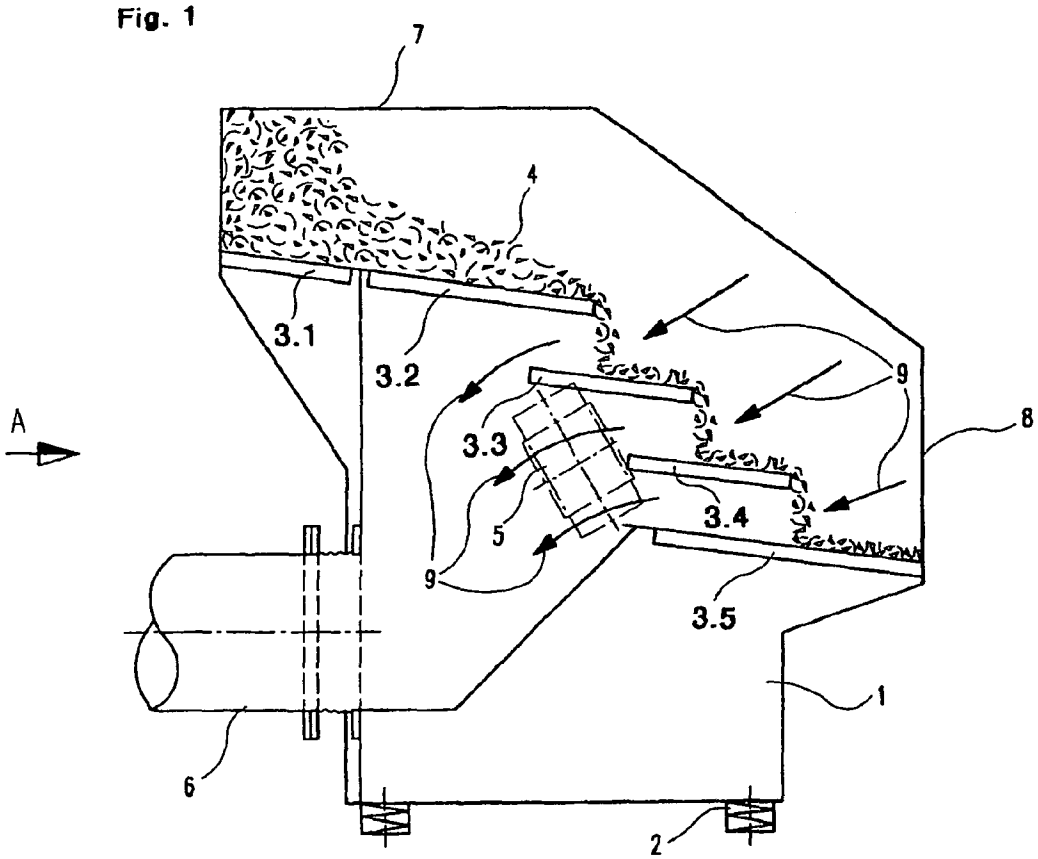

As can be seen from the drawing, the apparatus for separating residues comprises a housing 1 that abuts the bottom through swinging elements 2, in the case illustrated herein through compression springs. Inside the housing, a plurality of non-perforated plates 3.1 through 3.5 is connected to the housing, their inclination being adjustable. The plates are disposed in such a manner that the slag or residue 4 placed onto the uppermost and first plate 3.1 reaches first the plate 3.2, which exhibits substantially the same incline, before falling onto the plate 3.3 lying underneath, this process being continued until, via plate 3.4, the slag or the residues have reached plate 3.5 from where they are discharged to the outside.

This transport of residues or slag occurs through vibrations generated by vibrators 5. On the opposite side of the housing 1, which is not visible in the drawing, there is disposed a second vibrator 5 that generates vibration energy with movement components in the direction of the plates 3.1 through 3.5 that are extending downward.

Through a suction pipe 6, gas is drawn by means of a fan that has not been illustrated herein, said gas entering at the upper side 7 of the housing and being thereby in communication with the site in the waste treatment plant or on the firing grid in the region of which there still is a lot of unconsumed oxygen. The slag is supplied on the side indicated at 7.

The fact that this gas still contains quite a lot of oxygen is advantageous since this gas passes through the mass flows of the residues falling downward in a cascade, thereby promoting another reaction leading to improved burnout of the slag. As an alternative or in addition thereto, ambient air may also be supplied through the front side 8 of the housing.

The gas flows 9 between the oblique plates serve for wind sieving, i.e., they entrain the fines. On its further course, the suction pipe labelled at 6 is connected to a cyclone and then to a filter so that the fine fraction entrained in the gas flow may be obtained and recirculated, together with the combustion air, to the waste combustion process.

What is claimed is:

1. A method of separating residues from a thermal waste treatment into at least one fine fraction and one coarse fraction by which the residues are evacuated from a waste treatment plant in a dry state and separated into at least two fractions, wherein the residues are subjected to vibrations and conveyed downward in cascades over at least one stage on a plurality of non-perforated plates disposed diagonally offset one beneath the other and on freefall paths lying therein between, wherein the residues are conveyed along the plurality of non-perforated plates by vibrations and wherein, in the region of the freefall paths, the fine fraction is evacuated by wind sieving via a suction of gas flowing in a gas path having a gas horizontal direction opposite to a separation material horizontal direction of a separation path of the residues being separated along the plurality of non-perforated plates, the coarse fraction, except for the fine fraction evacuated by wind sieving, being conveyed along the cascade path.

2. The method as set forth in claim 1, wherein the plurality of non-perforated plates are disposed obliquely.

3. The method as set forth in claim 1, wherein the residues are conveyed downward over several stages.

4. The method as set forth in claim 1, wherein the fine fraction is evacuated by a gas flow in the region of the conveying vibration as well.

5. The method as set forth in claim 1, wherein the gas path runs transverse to the direction of fall.

6. The method as set forth in claim 1, wherein the gas path runs in a direction opposite to the conveying vibration.

7. The method as set forth in claim 1, wherein the wind sieving occurs on freefall paths and between the plurality of non-perforated plates at an adjustable gas speed of 2 through 10 m/s.

8. The method as set forth in claim 1, wherein the gas flow is first supplied to a cyclone separator after wind sieving and then subjected to a filtering process.

9. The method as set forth in claim 1, wherein the ambient air or gas used for wind sieving originates from a region of the waste treatment plant or waste incineration plant in which there is still a lot of unconsumed oxygen.

10. The method as set forth in claim 1, wherein the fine fraction separated through wind sieving is recirculated to thermal waste treatment.

11. The method as set forth in claim 1, wherein the wind sieving fumes are recirculated to the incineration plant.

12. The method as set forth in claim 1, wherein different flow velocities are adjusted between the discrete conveying plates.

* * * * *